US005175011A

United States Patent [19]

Courvoisier et al.

[11] Patent Number: 5,175,011

[45] Date of Patent: Dec. 29, 1992

[54] QUICK-OPENING BAG FOR PACKAGING, ESPECIALLY FOR VACUUM PACKAGING FOOD PRODUCTS IN PARTICULAR COFFEE

[75] Inventors: Michel Courvoisier, Laverune, France; Wolfgang Heilmann, Bremen, Fed. Rep. of Germany

[73] Assignee: Jacobs Suchard AG, Zurich, Switzerland

[21] Appl. No.: 782,788

[22] Filed: Oct. 24, 1991

Related U.S. Application Data

[63] Continuation of Ser. No. 527,555, May 23, 1990, abandoned.

[30] Foreign Application Priority Data

May 29, 1989 [FR] France ..... 89 07006

[51] Int. Cl.[5] ..... B65D 79/00

[52] U.S. Cl. ..... 426/123; 229/925; 383/200; 383/209; 426/122

[58] Field of Search ..... 426/122, 123, 124; 206/605, 606, 632, 524.8; 383/200, 209; 229/924, 925

[56] References Cited

U.S. PATENT DOCUMENTS 3,663,239 5/1972 Rowe et al. ..... 426/122
3,741,778 6/1973 Rowe ..... 426/122
3,873,735 3/1975 Chalin et al. ..... 383/200
4,176,567 12/1979 Weisberg ..... 83/30
4,428,485 1/1984 Egli ..... 206/524.8
4,927,028 5/1990 Hemm et al. ..... 206/632

FOREIGN PATENT DOCUMENTS 959716 3/1957 Fed. Rep. of Germany .
1486176 1/1969 Fed. Rep. of Germany .

*Primary Examiner*—Steven Weinstein
*Assistant Examiner*—Anthony Weier
*Attorney, Agent, or Firm*—Burns, Doane, Swecker & Mathis

[57] ABSTRACT

A bag for packaging products includes a generally parallelepiped-shaped body of composite sheet material having a rectangular closure zone formed at one end. A closure line extends across the closure zone between the upper and lower sides of the closure zone and a through cutout is formed in the closure zone at the closure line to facilitate opening of the bag. Preferably, the cutout is defined by first and second edges which are generally perpendicular to one another. The first edge is substantially perpendicular to the upper edge of the closure zone and the second edge adjoins the lower end of the first edge and extends substantially parallel to the upper and lower edges of the closure zone. The upper end of the first edge also extends above the upper edge of the closure zone.

26 Claims, 3 Drawing Sheets

QUICK-OPENING BAG FOR PACKAGING, ESPECIALLY FOR VACUUM PACKAGING FOOD PRODUCTS IN PARTICULAR COFFEE

This application is a continuation of application Ser. No. 07/527,555, filed May 23, 1990 now abandoned.

FIELD OF THE INVENTION

The present invention relates to a quick-opening bag for packaging, especially for vacuum packaging, food products in particular coffee.

BACKGROUND OF THE INVENTION

A tubular bag made of airtight flexible material which is hermetically sealed and folded so as to produce a package of substantially parallelepipedic shape is customarily used for the vacuum packaging of various products, especially ground or granular coffee. In most cases, the bag constitutes in practice an inner envelope coming directly into contact with the packaged product and is covered with an outer envelope folded so as to have the same parallelepipedic shape as the bag constituting the inner envelope.

In order to open the packet composed of the two envelopes in this way, it is necessary to lift the two triangular flaps forming the upper end face of the packet, separating them from one another so as to release the upper end zone of the bag. This end zone is composed of two rectangular surfaces projecting upwards from the upper face of the bag and the long sides of which are respectively the end edges of the opposite faces of the bag and fold lines at the level of the upper face of the bag, the bag being sealed in this rectangular zone by a linear region or weld line which extends parallel to the long sides of the rectangular zone, in general substantially midway between them.

In order to open the bag, it is necessary to break the weld line in the rectangular zone. In view of the mechanical characteristics of the material, such as a plastic film/aluminum foil composite, constituting the bag, this tearing is performed with difficulty and above all in a manner which is not reproducible from one bag to another, as a result of which the users, not being able to open the packet simply by tearing, in practice use cutting means such as scissors to open the bag.

SUMMARY OF THE INVENTION

The present invention sets out to provide a bag which, by particularly simple and economical means, permits quick opening of the bag simply by tearing, this opening being performed in a manner which is reliable and reproducible from one packet to another and additionally creating an open zone which forms a pouring spout.

The bag according to the invention is essentially characterized in that it comprises in its rectangular upper end zone, substantially in the center thereof, a through cutout which has an edge substantially perpendicular to the long sides of the rectangular zone and the upper end of which is situated between the weld line and the long upper side of the rectangular zone, the edge being continued substantially at right angles to its lower end by an edge arranged substantially parallel to the long sides of the rectangular zone between the weld line and the long lower side of the rectangular zone.

Preferably, the cutout is produced in the form of a triangle, in particular a right-angled triangle. The cutout may be produced by any appropriate method and is preferably produced by punching.

Advantageously, the bag has, in its rectangular upper end zone, a central weld region, for example of rectangular cross-section, covering the weld line in its central portion, the cutout being produced in this weld region in such a way that the upper end of its edge which is substantially perpendicular to the long sides of the rectangular end zone of the bag extends beyond the upper edge of the central weld zone upwards in the direction of the long upper side of the rectangular zone.

According to a particular feature of the invention, there are provided, in addition to the central weld region, two other, lateral, weld regions which extend from the short sides of the rectangular-shaped end zone, preferably level with the longitudinal weld line.

The weld zones are produced by any conventional method suited to the nature of the material used for the bag, for example by applying heat or using ultrasound depending on the particular case.

BRIEF DESCRIPTION OF THE DRAWING FIGURES

Other advantages and features of the bag according to the invention as well as the procedure for opening it will now be described by way of an example which is in no way limiting, with reference to the accompanying drawing in which like elements bear like reference numerals and wherein:

FIG. 1 illustrates a bag of the type according to the invention in the completely closed position, FIG. 2 illustrates the arrangement of the bag in the position in which it may be opened, FIG. 3 is a partial front elevation view of the bag of FIG. 2, FIG. 4 is a view similar to FIG. 3 illustrating the tearing of the bag during opening, FIG. 5 is a view similar to FIGS. 3 and 4 showing the arrangement of the bag when opened, FIG. 6 is a plan view corresponding to FIG. 5, and FIGS. 7 and 8 are views similar to FIG. 3 illustrating the different successive stages for the production of the bag according to the invention.

DETAILED DESCRIPTION OF THE PREFERRED EMBODIMENT

Figure 1:
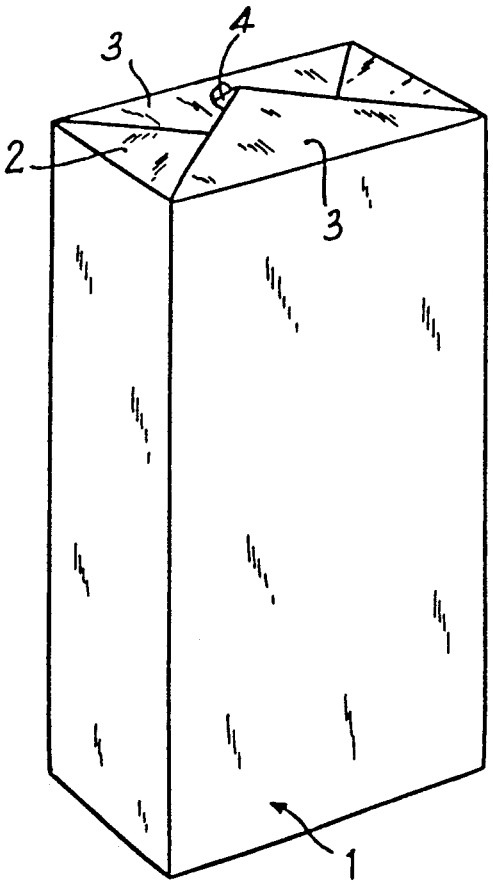
Figure 2:
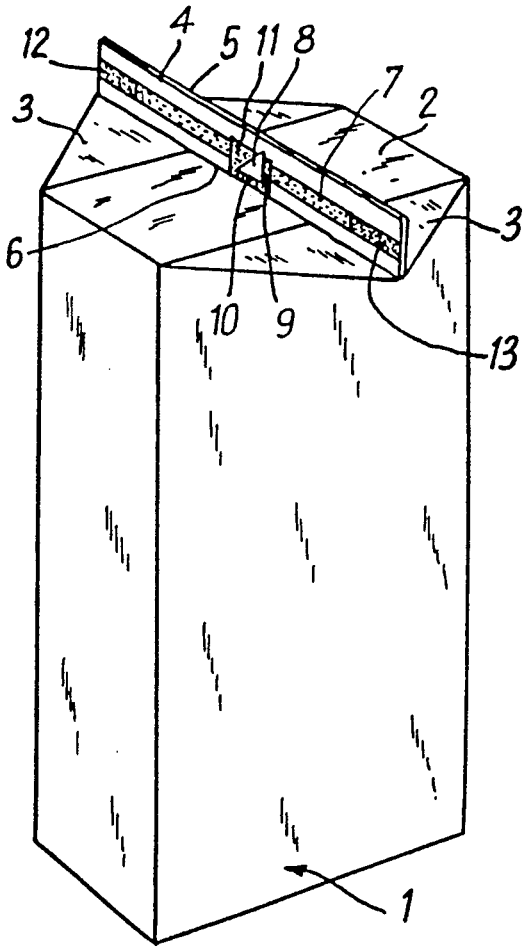
Figure 3:
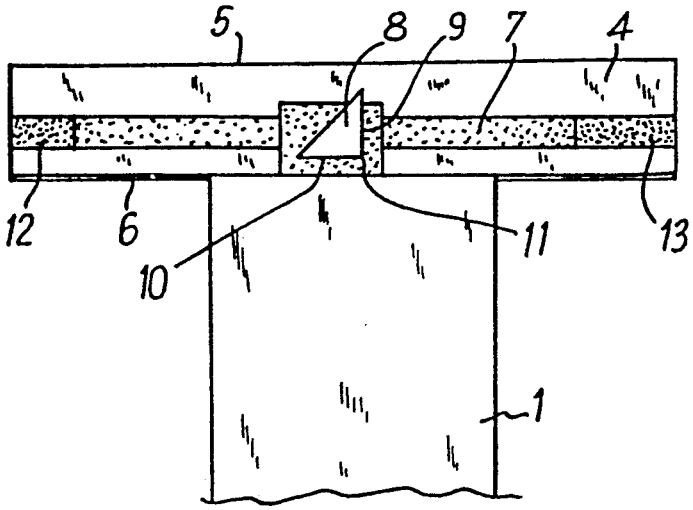

Reference is made first of all to FIGS. 1 to 3.

FIG. 1 shows, in the completely closed state, a bag according to the invention which is folded up so as to form a substantially parallelepipedic body 1 having a plane upper face onto which two triangular flaps 3 are applied.

On account of the folding configuration produced, this being conventional in itself, there is formed at the top of the bag a rectangular upper end zone 4 which extends transversely relative to the rectangular upper face 2 of the bag between the pointed portions of the triangular flaps 3.

This rectangular zone 4 which, as can be seen in FIG. 2, projects upwards once the triangular flaps 3 have been unfolded from the position illustrated in FIG. 1, is in fact formed by the application of the ends of the opposite faces of the bag onto one another.

The long side 5 of the rectangular zone, constituting the upper edge of this zone, is thus formed by juxtaposing the end edges of the opposite faces of the bag at the top of the latter. The long lower side 6 is formed by the lines for folding the ends of the opposite faces of the bag relative to the parts of the bag constituting the upper face 2 and the flaps 3.

In a conventional manner, the bag is sealed in the zone 4 by a weld line 7 which extends over the entire length of the latter substantially midway between the long upper side 5 and the long lower side 6. This weld line, produced for example by applying heat, seals the bag hermetically.

According to the invention, it is envisaged to produce a cutout 8, of triangular shape in the example illustrated, the slot having an edge 9 which is perpendicular to the sides 5 and 6 and is continued by an edge arranged parallel to these long sides 5 and 6, the two edges 9 and 10 being joined by an edge which is inclined so as to constitute a cutout in the form of a right-angled triangle.

This cutout passes through the two walls constituting the rectangular end zone 4 and is produced, for example, by punching with the aid of an appropriately shaped tool.

This cutout 8 is formed in a weld region 11, rectangular in the example illustrated, the upper end of the edge 9 of the slot 8 extending upwards beyond the upper edge of the weld region 11. This weld region 11 is produced substantially in the central portion of the zone 4. In the example illustrated, this region is slightly offset to the left relative to the middle of the zone 4.

Finally, there are also provided according to the invention in the rectangular zone 4 two lateral weld regions 12 and 13 which preferably extend from the short sides of the rectangular zone 4. As can be seen in the drawing, the central weld region 11 is arranged on either side of and covering the weld line 7, whereas the regions 12 and 13 are arranged at the same height as the weld line 7.

In order to open a bag according to the invention, the flaps 3 are separated from the position of FIG. 1 so as to be in the position illustrated in FIG. 2.

The user then grasps the right-hand portion of the projecting rectangular upper zone 4 with one hand and the left-hand portion of this zone with the other hand.

Figure 4:
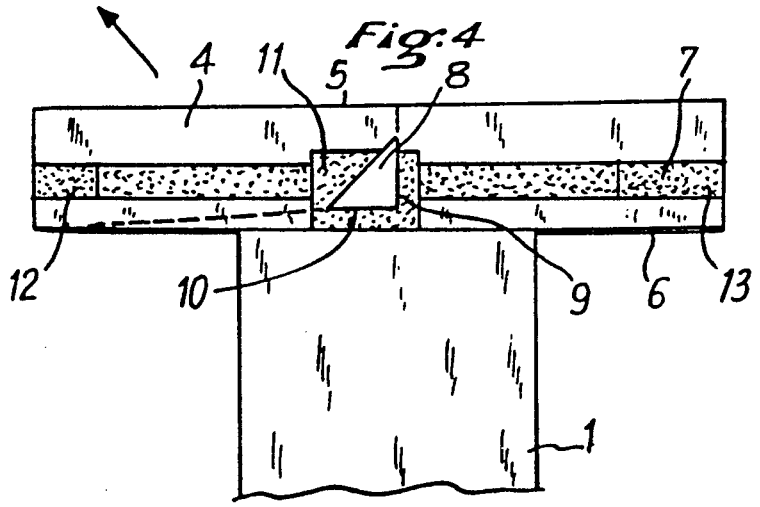

He then exerts with this other hand traction directed upwards substantially in the direction indicated by the arrow in FIG. 4 so as to bring about the rupturing of the bag.

Figure 5:
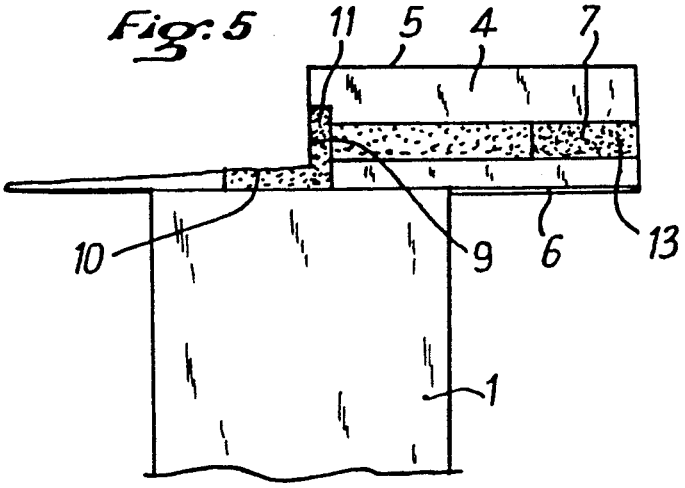

Owing to the presence of the slot 8, this rupturing takes place in a determined manner along the lines shown schematically in broken lines in FIG. 4, so that a tearing of the entire left-hand portion of the zone 4 occurs. FIG. 5 and also FIG. 6 show the bag after tearing.

Figure 6:
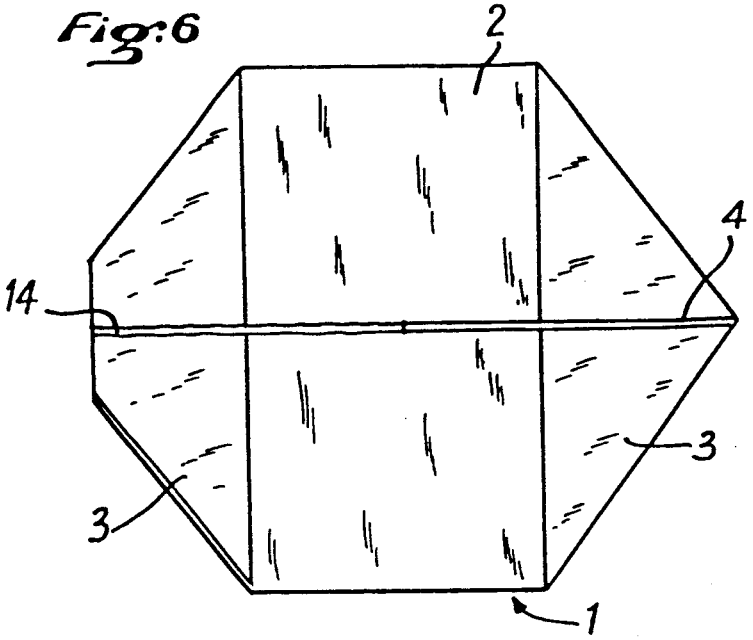

As can be seen in FIG. 6, there is formed at the top of the bag a slit 14 which, by lifting the end edges of the bag, forms a pouring-spout orifice.

It will be understood that the slot 8 imposes lines of determined rupture in order to open the bag, as a result of which an opening is easily and reliably obtained and is reproducible from one bag to another.

Figure 7:
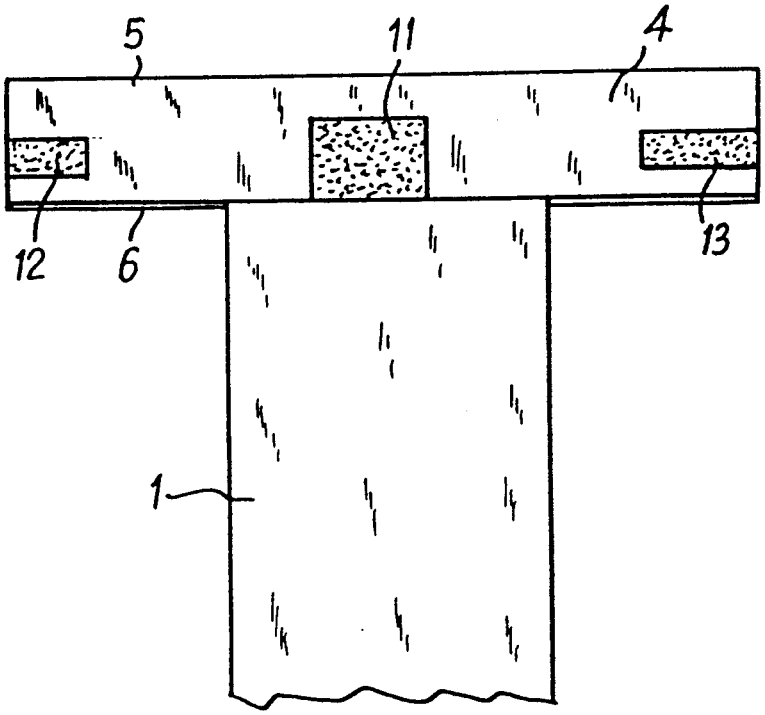
Figure 8:
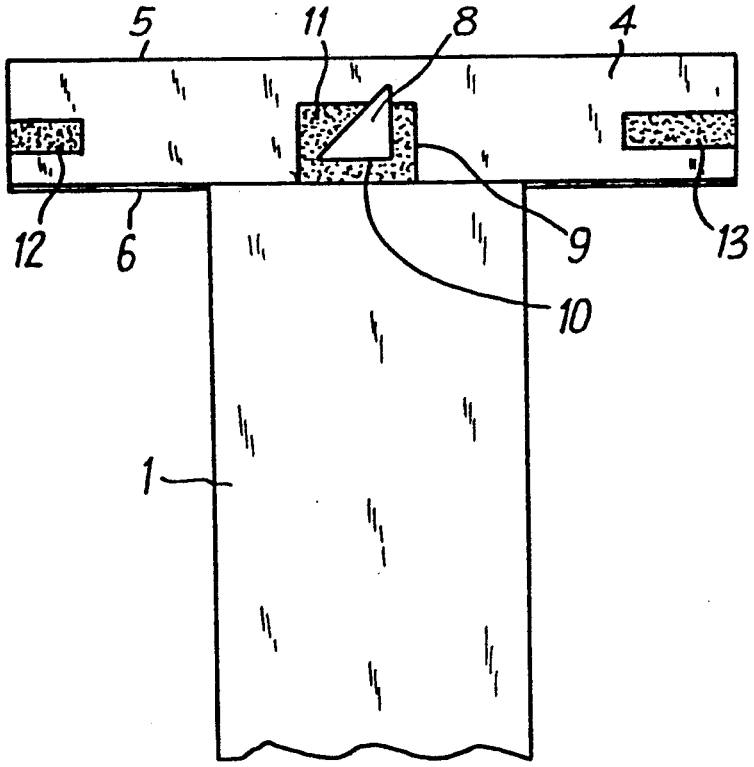

FIGS. 7 and 8 illustrate two stages of production of the upper end portion of the bag according to the invention.

As can be seen in FIG. 7, once the product to be packaged has been placed within the interior space 1 of the bag, presealing of the opposite faces of the bag is carried out at their upper end by welding in the zones 11, 12, 13 as illustrated in FIG. 7.

The slot 8 is then produced by punching as illustrated in FIG. 8, after which a negative pressure is applied in order to create a vacuum in the interior space of the bag, and finally welding is carried out along the line 7 so as to seal the bag completely in a leaktight manner.

It is then sufficient to fold down the flaps 3 and to fasten them in order to attain the completely closed position illustrated in FIG. 1.

The bag illustrated in the drawing may, of course, be used as it is but preferably constitutes an inner envelope which is accommodated inside an outer envelope so as to constitute a double-envelope packet for the vacuum packaging of ground or granular coffee, for example.

Of course, the invention is not limited to such an application.

Although the invention has been described in connection with a specific embodiment, it is obvious that it is in no way limited thereto and that it is possible for it to have a number of variants and modifications without thereby either departing from its scope or its spirit.

We claim:

1. A bag for packaging products, comprising:

a generally parallelpiped-shaped body of composite sheet material having a generally rectangular closure zone formed at an upper end, said generally rectangular closure zone including an upper side defining a border edge and an oppositely located lower side, said generally rectangular closure zone having a closure line extending across the length thereof, said closure line being positioned between the upper and lower sides of the closure zone and sealing together wall portions of the body, a through cutout positioned in a center region of the closure line with respect to its longitudinal extent, said through cutout being defined by at least first and second edges positioned substantially perpendicular to one another, said first edge being positioned substantially perpendicular to said upper side and said first edge having oppositely positioned upper and lower ends, said second edge adjoining the lower end of the first edge and extending substantially parallel to the upper and lower sides of the closure zone, said closure line having upper and lower edges, and said second edge being positioned below the lower edge of said closure line.

2. The bag according to claim 1, wherein said cutout is substantially triangular in shape.

3. The bag according to claim 1, wherein said cutout is formed by punching.

4. The bag according to claim 1, wherein said closure zone includes a generally rectangular weld region covering a portion of the longitudinal extent of the closure line and extending above the upper edge of the closure line and below the lower edge of the closure line, said cutout being positioned in the weld region and the upper end of the first edge of the cutout extending beyond a top edge of the weld region.

5. The bag according to claim 1, wherein said closure zone includes oppositely positioned short sides extending between the upper and lower sides, and including two oppositely positioned lateral weld regions which extend inwardly from the short sides of the closure zone, said lateral weld regions having upper and lower edges that are substantially coincident with the upper edge and the lower edge of the closure line respectively.

6. The bag according to claim 1, wherein the bag is used to vacuum package food products.

7. The bag according to claim 6, wherein said food product is coffee.

8. The bag according to claim 1, wherein the bag is positioned within an outer envelope having a generally parallelpiped shape.

9. The bag according to claim 2, wherein said cutout is formed by punching.

10. The bag according to claim 3, wherein said closure zone includes a generally rectangular weld region covering a portion of the longitudinal extent of the closure line and extending above the upper edge of the closure line and below the lower edge of the closure line, said cutout being positioned in the weld region and the upper end of the first edge of the cutout extending beyond a top edge of the weld region.

11. A bag for packaging products, comprising:

a generally parallelpiped-shaped body of composite sheet material having a generally rectangular closure zone formed at an upper end, said generally rectangular closure zone including an upper side and an oppositely located lower side, said closure zone having a closure line extending thereacross, said closure line being positioned between the upper and lower sides of the closure zone and sealing together portions of the composite sheet material, a through cutout located in the closure line, said cutout being defined by first and second edges, said first edge extending in the direction of the upper edge of the closure zone and said second edge extending toward a short side of the closure zone that is positioned between the upper and lower sides of the closure zone, said closure line having upper and lower edges, and said second edge being positioned below the lower edge of said closure line.

12. The bag according to claim 11, wherein said cutout is formed in a central region of the closure line with respect to a longitudinal extent of the closure line.

13. The bag according to claim 11, wherein said cutout is generally triangular in shape.

14. The bag according to claim 11, including a weld region covering a portion of the longitudinal extent of the closure line, said cutout being positioned in the weld region.

15. A bag for packaging products, comprising:

a generally parallelpiped-shaped body of composite sheet material having walls, the oppositely situated walls at one end of the body being placed closely adjacent to one another to a generally rectangular closure zone at an upper end of the body, said generally rectangular closure zone including an upper side defining a border edge of the bag and an oppositely located lower side, said generally rectangular closure zone having a closure line extending across substantially the entire length thereof, said closure line being positioned between and spaced from the upper and lower sides of the closure zone and sealing together wall portions of the body, said closure line extending substantially parallel to the upper and lower sides of the closure zone, a through cutout positioned in a center region of the closure line with respect to its longitudinal extent, said through cutout being defined by at least first and second edges positioned substantially perpendicular to one another, said first edge being positioned substantially perpendicular to said upper side and having oppositely positioned upper and lower ends, the lower end of the first edge being located closer to the lower side of the closure zone than the upper end of the first edge, said second edge adjoining the lower end of the first edge and extending substantially parallel to the upper and lower sides of the closure zone, the closure line having upper and lower edges, the second edge being positioned between the lower side of the closure zone and the lower edge of the closure line.

16. The bag according to claim 15, wherein said second edge includes a first end that adjoins the lower end of the first edge and an oppositely positioned second end, said through cutout being configured and positioned to result in first and second lines of determined rupture upon opening of the bag, said first line of determined rupture extending from said second end of the second edge toward the lower side of the closure zone.

17. The bag according to claim 15, wherein said through cutout is configured and positioned to result in first and second lines of determined rupture upon opening of the bag, said second line of determined rupture extending from the upper end of the first edge toward the upper side of the closure zone.

18. The bag according to claim 15, including a weld region formed in a central region of the closure line with respect to its longitudinal extent, said weld region having a lower edge that is positioned below the lower edge of the closure line in the direction of the lower side of the closure zone, said second edge defining the through cutout being positioned in said weld region between said lower edge of said closure line and said lower edge of said weld region.

19. The bag according to claim 18, wherein said weld region includes an upper edge positioned opposite said lower edge, said upper end of the first edge being positioned above the upper edge of the weld region and being positioned between the upper side of the closure zone and the upper edge of the closure line.

20. The bag according to claim 18, wherein the lower edge of the weld region extends to the lower side of the closure zone.

21. The bag according to claim 18, wherein said weld region has an upper edge positioned opposite said lower edge of the weld region, the upper edge of the weld region extending above the upper edge of the closure line in the direction of the upper side of the closure zone.

22. The bag according to claim 21, wherein the upper end of the first edge of the through cutout extends above the upper edge of the weld region.

23. The bag according to claim 1, including a weld region positioned in the closure zone and along a portion of the longitudinal extent of the closure line, said weld region having a lower edge extending below the lower edge of the closure line and an oppositely positioned upper edge, said second edge defining the through cutout being positioned in said weld region and being located between the lower edge of the closure line and the lower edge of the weld region.

24. The bag according to claim 23, wherein said first edge defining the through cutout extends above the upper edge of the closure line and the upper edge of the weld region, the upper edge of the weld region being positioned between the upper edge of the closure line and the upper end of the closure zone.

25. The bag according to claim 11, including a weld region positioned in the closure zone and along a portion of the longitudinal extend of the closure line, said weld region having a lower edge extending below the lower edge of the closure line and an oppositely positioned upper edge, said second edge defining the through cutout being positioned in said weld region and being located between the lower edge of the closure line and the lower edge of the weld region.

26. The bag according to claim 25, wherein said first edge defining the through cutout extends above the upper edge of the closure line and the upper edge of the weld region, the upper edge of the weld region being positioned between the upper edge of the closure line and the upper end of the closure zone.

* * * * *